US005338468A

United States Patent [19]

Arvizzigno et al.

[11] Patent Number: 5,338,468

[45] Date of Patent: Aug. 16, 1994

[54] SULFURIZED OLEFINS

[75] Inventors: Joseph A. Arvizzigno, Brooklyn, N.Y.; Henry Ashjian, East Brunswick; Roger P. Napier, Washington, both of N.J.

[73] Assignee: Mobil Oil Corporation, Fairfax, Va.

[21] Appl. No.: 956,195

[22] Filed: Oct. 5, 1992

[51] Int. Cl.[5] ..... C10M 135/00; C10M 135/02

[52] U.S. Cl. ..... 252/45; 568/59

[58] Field of Search ..... 252/45; 568/59, 21

[56] References Cited

U.S. PATENT DOCUMENTS 5,135,670 8/1992 Johnson et al. ..... 252/46.4

*Primary Examiner*—John Niebling
*Assistant Examiner*—Edna Wong
*Attorney, Agent, or Firm*—Alexander J. McKillop; Malcolm D. Keen; Charles A. Malone

[57] ABSTRACT

A procedure for the incorporation of sulfur into olefins which produces a non-staining, low odor, EP-active gear oil additive by reacting an olefin such as isobutylene with elemental sulfur in the presence of an aqueous solution of a strong base such as ammonia.

13 Claims, No Drawings

SULFURIZED OLEFINS

BACKGROUND OF THE INVENTION

1. Field of the Invention

This application is directed to a novel process of making sulfurized olefins, e.g., sulfurized isobutylene and to lubricant compositions containing such sulfurized isobutylene.

The metal surfaces of machinery or engines operating under heavy loads wherein metal slides against metal may undergo excessive wear or corrosion. Often the lubricants used to protect the metal surfaces deteriorate under such heavy loads and as a result, do not prevent wear at the points of metal to metal contact. Consequently, the performance of the machine or engine will suffer, and in aggravated cases the machine or engine may become completely inoperative.

There have been many attempts to devise additive systems which would provide satisfactory protection, but these have not always been successful. Furthermore, some of these additives are mixed with undesirable and/or malodorous by-products.

Sulfurized olefins have been extensively used in many lubricant applications requiring extreme pressure/antiwear activity. These sulfurized olefins which include sulfurized $C_3$–$C_8$ olefins such as isobutylene are described by A. G. Horodysky in U.S. Pat. Nos. 3,703,504; 3,703,505; and 3,873,454. These patents and U.S. Pat. No. 4,240,958 generally employ methods of preparing their sulfurized products wherein the olefin is sulfohalogenated with a sulfur halide at some stage in their synthesis.

The direct sulfurization of olefins such as triisobutylene with sulfur is described, for example, in U.S. Pat. Nos. 2,995,569 and 3,796,661. These patents describe the formation of predominantly dithiol-thione type compositions made at elevated temperatures at both low and elevated pressures. U.S. Pat. No. 4,194,980 discloses cyclic sulfurized olefins prepared by reacting an olefin with a cyclic polydisulfide. U.S. Pat. Nos. 3,345,380 and 2,535,706 describe methods of making various thiones by reacting elemental sulfur and unsaturated hydrocarbons.

Sulfurized olefins have also been prepared by the direct sulfurization of olefins with sulfur and hydrogen sulfide, see U.S. Pat. Nos. 2,337,473; 4,119,549; 4,119,550; 4,191,659; 4,344,854 and 4,147,640. U.S. Pat. No. 4,147,640, for example, describes the sulfurization of various olefinic hydrocarbons such as dicyclopentadiene with sulfur and hydrogen sulfide.

Thus, it is well known that many methods have been used for producing organic sulfides by treating olefins. It is also well known that many sulfurized organic compositions are useful as lubricant additives. Typically the prior art processes provide sulfurized products having undesirably high levels of thiones, such as dithiolthiones (or dithiolethiones), and high levels of thiones in combination with various complex sulfurized mixtures. Typically also these processes which are expensive and difficult to control provide products having a highly disagreeable odor. However, the specific and significantly improved discreet compositions produced by the narrowly defined processing conditions disclosed herein provide thermally and oxidatively stable, noncorrosive, low-odor, extreme pressure/antiwear additives for lubricating oils, greases and fuels.

U.S. Pat. No. 4,191,659 to Davis claims a method of making sulfurized compounds by contacting olefinic feedstock with sulfur, hydrogen sulfide and an ammonia or amine catalyst.

U.S. Pat. No. 4,119,550 to Davis et al. claims a method of preparing sulfurized compounds by contacting an olefinic feedstock with sulfur and hydrogen. The olefin can be isobutene and the catalyst can be ammonia or an amine.

U.S. Pat. No. 4,119,549 to Davis claims a method of making sulfurized materials by contacting olefinic compounds with sulfur and hydrogen sulfide. Isobutene is disclosed as a suitable olefin and the catalyst can be an amine or ammonia.

Dithiolethione-free sulfurized olefin compositions have been prepared by the reaction of sulfur, isobutylene and hydrogen sulfide as exemplified by U.S. Pat. No. 4,344,854 to Davis et al. noted above.

The above-identified '659, '549, '550 and '854 patents "require" that hydrogen sulfide be added in specified proportions as a "separate and distinct" reactant.

The use of sulfurized olefins has been well-known for their extreme-pressure and antiwear properties when formulated into lubricants, as exemplified, for example, by U.S. Pat. No. 3,703,504 to Horodysky noted above.

It has now been discovered that the reaction of sulfur and isobutylene in the presence of an aqueous strong base produces a non-staining, low odor, sulfurized isobutylene product having EP-active characteristics and suitable for use as for example a gear oil additive.

BRIEF SUMMARY OF THE INVENTION

This invention, in general, comprises reacting elemental sulfur and suitable olefins in the presence of an aqueous solution of a strong base to obtain customized sulfurized olefins which provide EP characteristics to lube oils when incorporated therein. These additive products are also non-staining and have low odor as well as providing copper corrosion and demulsifying characteristics to such compositions. These novel sulfurized reaction products are also believed useful in fuel applications.

DESCRIPTION OF PREFERRED EMBODIMENTS

Sulfurized olefins in accordance with the invention are prepared by the direct reaction of elemental sulfur, olefins, such as isobutylene and a strong base, such as ammonia, in aqueous solution. This method generates little or no waste since the aqueous base, e.g., ammoniacal layer (by-products), is recyclable.

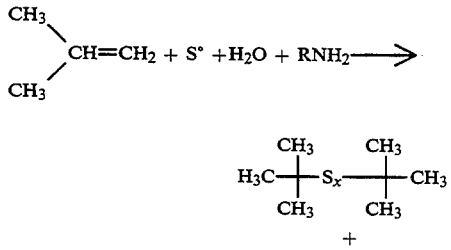

-continued

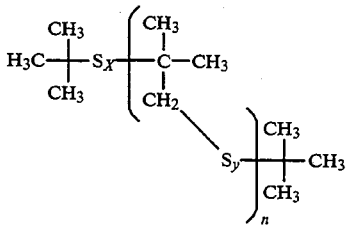

Where R=H or $C_2$ to $C_{32}$ hydrocarbyl, x=1 to 6, y=1 to 6 and n=1 to 10.

Although isobutylene may be the preferred olefin, other olefins and other butylenes, as well as pentenes, propylenes, propylene dimers, trimers, tetramers and butylene dimers, trimers, etc., in general $C_2$ to about $C_{32}$ olefins are suitable for use herein.

Although ammonia is the preferred base, other strong bases may also be used, such as for example, aliphatic, aromatic, or alicyclic amines with at least 1.0% but preferably >1.0% water solubility.

The reaction conditions must be strictly controlled. The pressure is generally autogenous or may vary from about 180 to 1500 psi, the temperature can vary from 140° to 200° and preferably is about 165° C. or 150°–180° C., the molar ratio of olefin to sulfur to water to base can vary from 1/1.0/1.25/0.2/0.2 to about 1.0/2.75/1.2/0.8 moles, preferably about 1.0/1.9/1.1/0.32 moles. The reaction time will depend upon the specific reactants but generally is from about 2 to about 12 hours.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. to about 6000 SSU at 100° F. and preferably, from about 50 to about 250 SSU at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers. Ester-based lubricants are highly suitable.

It is to be understood, however, that the compositions contemplated herein can also contain other materials used for their known properties. For example, corrosion inhibitors, extreme pressure agents, low temperature properties modifiers and the like can be used as exemplified respectively by metallic phenates or sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples are exemplary only and are not meant to be limitations of the invention.

EXAMPLE 1

One mole of isobutylene is charged to a stainless steel reactor along with 1.9 moles of elemental sulfur, 1.1 moles of water, and 0.32 moles $NH_3$. The reactants are heated to 165° C. for 8 hours under pressure. After cooling to 100° C. (residual pressure is vented through scrubbers and the reaction mixture is allowed to phase separate), the organic layer is sparged with a gas for 2 hours and filtered.

EXAMPLE 2

To a stainless steel pressure autoclave is charged 1.9 moles of elemental sulfur, 1.1 moles of water, and 0.32 moles of $NH_3$. The reactants are heated to 165° C. under pressure. Isobutylene is added semi-batchwise over about 3 hours. The reactants are then allowed to react for a total of 8 hours at 165° C. The reaction mixture is then worked up as described in Example 1.

EXAMPLE 3

This is Comparative Example A made via the method described in application Ser. No. 07/566,926, filed Aug. 14, 1990, entitled "IMPROVED SULFURIZED OLEFIN EXTREME PRESSURE/ANTIWEAR ADDITIVES", now pending.

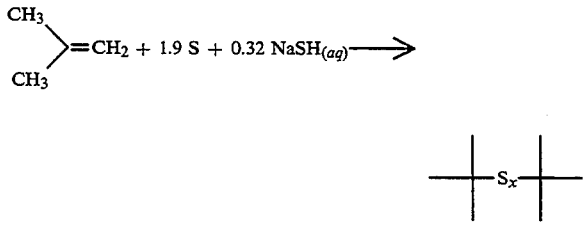

EXAMPLE 4

This is Comparative Example B, a prior art commercial material (U.S. Pat. No. 2,708,199).

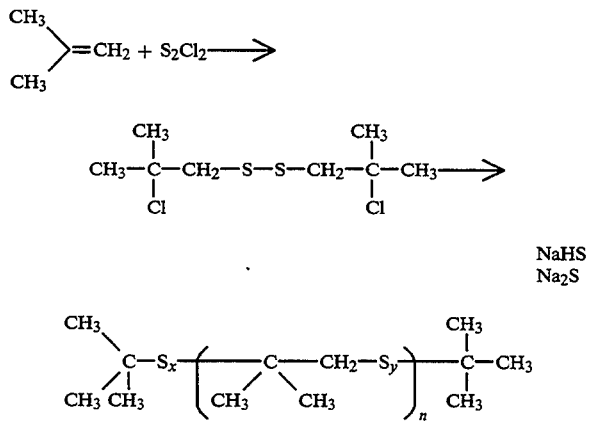

x = 1 or 2
y = 1 or 2

EVALUATION OF PRODUCTS

The Four-Ball Wear Test was performed in accordance with ASTM D-2266; see U.S. Pat. No. 4,761,482 incorporated herein by reference for a further description of the test. The results are shown in Table 1 below.

TABLE 1

A 1.5 wt % blend of material from Example 1 was made in ISO VG 220 oil. Results are shown below.

| | Weld Point (Kg) | Load Wear Index |
|---|---|---|
| Example 1 | 500 | 78.4 |
| Example 3 (Comparative Ex.) | 400 | 65.14 |
| Example 4 (Comparative Ex.) | 400 | 61.5 |

The results in Table 1 demonstrate the improved quality of the products produced in accordance with the invention.

The EP/antiwear activity was also determined by evaluations using CRC L-42 Gear Test. This test is referred to in, for example, U.S. Pat. No. 4,432,552. A package was formulated from material in Example 1. This package was 5.5 wt % in 80W-90 oil. Test data is summarized in Table 2 below.

TABLE 2

| | HPSIB* | Reference Oil (RGO-1103) |
|---|---|---|
| Ring gear, drive side | no scoring | no scoring |
| Ring gear, coast side | 3% scoring | 13% scoring |
| Pinion gear, drive side | no scoring | no scoring |

TABLE 2-continued

| | HPSIB* | Reference Oil (RGO-1103) |
|---|---|---|
| Pinion gear, coast side | 4% scoring | 15% scoring |

*High pressure sulfurized isobutylene

The results of this test clearly demonstrate the utility of the additives in accordance with the invention as gear oil additives.

Products of this invention were also evaluated for copper corrosivity using the ASTM D130 Copper Strip Corrosion Test using a background concentration of copper passivator. Test data is shown in Table 3.

TABLE 3

| | |
|---|---|
| Example 1 | lb |
| Example 2 | lb |
| Example 3 | lb |
| Example 4 | lb |

nCorrosion Test Rating
n1 represents zero to slight tarnish;
n2 represents moderate tarnish; and
na and b represent shading within numerical grade (a>b).

The above test results show the good control of copper corrosivity exhibited by these sulfur-containing compositions.

The use of additive concentrations of sulfurized olefins prepared in the manner of the present invention in premium quality automotive and industrial lubricants will significantly increase their performance, increase their stability and extend the service life of the lubricants. The present products are useful at low concentrations and do not contain any potentially undesirable metals or phosphorus.

What is claimed is:

1. A lubricant composition comprising a major proportion of an oil of lubricating viscosity or grease prepared therefrom and a minor amount of a non-staining, low odor multifunctional antiwear/antioxidant/copper corrosion inhibiting additive product of reaction free or substantially free of dithiolethione compounds prepared by reacting isobutylene and elemental sulfur with a base selected from the group consisting of ammonia, aliphatic, aromatic or alicyclic amines with at least 1.0% water solubility in the presence of predetermined amounts of added water to form the desired additive product of reaction and wherein the reaction is carried out at temperatures varying from 140° C. to 200° C., pressures varying from 180 psi to 1500 psi or are autogenous and in molar ratios of isobutylene to sulfur to water to base varying from 1.0/1.25/0.2/0.2 to 1.0/2.75/1.2/0.8 and with a reaction time varying from 2 to about 12 hours.

2. The composition of claim 1 wherein the base selected has >1.0% water solubility.

3. The composition of claim 1 wherein the base is ammonia.

4. The composition of claim 1 wherein the reaction temperature varies from 150° C. to 180° C., the pressure is autogenous or varies from 180 psi to 1500 psi and the molar ratio of isobutylene to sulfur to water to base is about 1/1.9/1.1/0.32.

5. The composition of claim 1 wherein the lubricant is an oil of lubricating viscosity selected from the group consisting of (1) mineral oils, (2) synthetic oils, or (3) mixtures of mineral and synthetic oils or is (4) a grease prepared from any one of (1), (2) or (3).

6. The composition of claim 1 wherein the lubricant contains from about 0.001 to about 10 wt % based on the total weight of the composition of the additive product of reaction.

7. The composition of claim 4 wherein the lubricant is a mineral oil.

8. A process of preparing a sulfurized olefinic reaction product free or substantially free of dithiolethione compounds having utility as a multifunctional antioxidant, antiwear, copper corrosion inhibiting additive product prepared by reacting isobutylene and elemental sulfur with a base selected from the group consisting of ammonia, aliphatic, aromatic or alicyclic amines with at least 1.0% water solubility in the presence of predetermined amounts of added water to form the desired additive product of reaction and wherein the reaction is carried out at temperatures varying from 140° C. to 200° C., pressures varying from 180 psi to 1500 psi or autogenous and in molar ratios of isobutylene to sulfur to water to base varying from 1/1.25/0.2/0.2 to 1/2.75/1.2/0.8 and with a reaction time varying from 2 to 12 hours.

9. The process of claim 8 wherein the base is ammonia.

10. The process of claim 8 wherein the reaction temperature varies from 150° C. to 180° C., the pressure varies from 180 psi to 1500 psi or is autogenous and the molar ratio of isobutylene to sulfur to water to base is about 1/1.9/1.1/0.32.

11. A multifunctional antiwear/antioxidant lubricant additive product of reaction prepared by reacting isobutylene and elemental sulfur with a base selected from the group consisting of ammonia, aliphatic, aromatic or alicyclic amines with at least 1.0% water solubility in the presence of predetermined amounts of added water to form the desired additive product of reaction and wherein the reaction is carried out at temperatures varying from 140° C. to 200° C., pressures varying from 180 psi to 1500 psi or is autogenous and in molar ratios of isobutylene to sulfur to water to base varying from to 1/1.25/0.2/0.2 to 1/2.75/1.2/0.8 and with a reaction time varying from 2 to 12 hours.

12. The additive product of reaction as claimed in claim 11 wherein the base is ammonia.

13. A method of preparing a lubricant composition comprising adding to a lubricant of lubricating viscosity or grease a minor multifunctional antiwear/antioxidant amount of from about 0.001 to about 10 wt % based on the total weight of the composition of an additive product of reaction prepared by reacting isobutylene and elemental sulfur with a base selected from the group consisting of ammonia, aliphatic, aromatic or alicyclic amines with at lease 1.0% water solubility in the presence of predetermined amounts of added water to from the desired additive product of reaction and wherein the reaction is carried out at temperatures varying from 140° C. to 200° C., pressures varying from 180 psi to 1500 psi or is autogenous and in molar ratios of isobutylene to sulfur to water to base varying from to 1/1.25/0.2/0.2 to 1/2.75/1.2/0.8 and with a reaction time varying from 2 to 12 hours.

* * * * *